US008277566B2

(12) United States Patent
Rubenzer et al.

(10) Patent No.: US 8,277,566 B2
(45) Date of Patent: Oct. 2, 2012

(54) MAT WASHING MACHINE AND METHOD

(75) Inventors: Randall D. Rubenzer, Bloomer, WI (US); Robert M. Simons, Cameron, WI (US)

(73) Assignee: Indianhead Pipeline Services, LLC, Eau Claire, WI (US)

( * ) Notice: Subject to any disclaimer, the term of this patent is extended or adjusted under 35 U.S.C. 154(b) by 334 days.

(21) Appl. No.: 12/535,036

(22) Filed: Aug. 4, 2009

(65) Prior Publication Data

US 2011/0030727 A1 Feb. 10, 2011

(51) Int. Cl.
*B08B 1/02* (2006.01)
*B08B 1/04* (2006.01)

(52) U.S. Cl. ..... 134/15; 134/9; 134/32

(58) Field of Classification Search ..... 134/26, 134/32, 63, 82, 15; 15/88.3, 90, 77
See application file for complete search history.

(56) References Cited

U.S. PATENT DOCUMENTS

| | | | | | |
|---|---|---|---|---|---|
| 593,870 | A | | 11/1897 | Andersen | |
| 2,552,871 | A | | 5/1951 | Shaw | |
| 2,613,383 | A | * | 10/1952 | Rousseau | 15/181 |
| 3,115,361 | A | * | 12/1963 | Miles | 294/112 |
| 3,633,593 | A | | 1/1972 | Slaats | |
| 3,696,563 | A | * | 10/1972 | Rands | 451/466 |
| 4,042,993 | A | | 8/1977 | Cervin | |
| 4,047,549 | A | | 9/1977 | Ratelle et al. | |
| 4,103,389 | A | | 8/1978 | Resnick et al. | |
| 4,690,187 | A | | 9/1987 | Schmidt | |
| 5,188,500 | A | | 2/1993 | Eide et al. | |
| 5,688,159 | A | | 11/1997 | Kusano et al. | |
| 6,129,099 | A | * | 10/2000 | Foster et al. | 134/57 R |
| 2007/0056612 | A1 | * | 3/2007 | Robert et al. | 134/61 |
| 2008/0135061 | A1 | | 6/2008 | Madgar | |
| 2011/0017245 | A1 | * | 1/2011 | Vernon et al. | 134/122 R |

OTHER PUBLICATIONS

Yukari Nakamura, International Search Report—Mailed Nov. 15, 2010, PCT/US2010/043254, Filed Jun. 26, 2010.
Yukari Nakamura, Written Opinion of the International Searching Authority—Mailed Nov. 15, 2010, PCT/US2010/043254, Filed Jun. 26, 2010.

* cited by examiner

*Primary Examiner* — Michael Kornakov
*Assistant Examiner* — Natasha Campbell
(74) *Attorney, Agent, or Firm* — Anthony J Bourget

(57) ABSTRACT

Mat washing device, method of using the mat washing device, and method of washing mats. The mat washing device includes a system that may be transported on a flat bed trailer from one location to another. The mat washing device includes conveying systems, brush systems, rails systems and control mechanisms. The mat washing device may be used by placing mat, on edge, on a conveying system and conveying the mat to a first brushing system and a second brushing system. In one aspect the first brushing system includes a cable brush having a bolt secured at the end of a cable in order to beat or brush material from the mat when the cable brush is spun.

22 Claims, 18 Drawing Sheets

MAT WASHING MACHINE AND METHOD

BACKGROUND OF THE INVENTION

1. Field of the Invention

This invention is generally directed to cleaning devices and more specifically relates to washing devices.

2. Background Information

Mats are known in the art for use in construction sites. Often times, wooden mats are used at constructions sites. Wooden mats may be utilized for any purpose, but are often used to support loads or as structural protection.

Mats are often assembled from a group of heavy duty elongated wooden members placed parallel and joined by a joining mechanism. Mats range in sizes from a thickness of between eight to twelve inches, a width of four to five feet, and a length of eight to fifty two feet. Thus, mats may be extremely large, heavy and difficult to handle. Although wood mats are discussed, any material may be used to make the mats used at construction sites. Further, it is known that the mats may be constructed and then transported to a construction site or other site, or the mats may be constructed at a specific site.

SUMMARY OF THE INVENTION

Although mat structures may be well known in the art, the inventor has realized that mats used at construction sites, often known as swamp mats, and other sites become dirty during use. Also, the inventor has realized that up until this invention mats used at construction sites and other sites are not easily cleaned by known methods of cleaning. Further, the inventor has realized deficiencies in known cleaning methods and has developed a novel device and method to clean mats.

Generally, an embodiment of the invention includes a portable structure that may have adjustable height. The invention may include a first conveyor that receives mats and is capable of transporting the mat from a first end of the conveyor to a second end of the conveyor. A primary brush system may be located toward the second end of the first conveyor and may receive the transported mat. Once the mat has passed through the primary brush system, the mat may engage a second conveyor. The second conveyor may transport the mat from a first end of the second conveyor to a second end of the second conveyor where a secondary brush system may be located. The mat may then be inserted into the secondary brush system. When the mat passes through the secondary brush system, the mat may engage a third conveyor that transports the mat out of the secondary brush system to an exit from the portable structure.

The portable structure may be elevated off the ground with adjustable legs and feet. If included, there may be any number of legs and/or feet, but preferably at least two sets of legs and feet are utilized. The legs may be secured to a main frame, along with a rail system. The rail system may be utilized for guiding mat structures through the transportable structure/system. Further, there may be a conveyor or conveyors attached to the main frame.

An objective of the invention is to provide a system that may include a water recycling system that allows for utilizing a limited quantity of water at remote work sites or any other work sites.

An objective of the invention is to provide a system to which additional features may be easily attached as needed. For example, additional conveyors may be attached to the portable system to assist in removing mats from the system after the mats have been washed or additional conveyors may be attached at angles perpendicular to the direction of mat transport of a mat for any purpose, particularly including assisting in the removal of debris from the washing system.

An objective of the invention is to provide a device that may be used in a method for cleaning mats. The method may include conveying a mat along a conveying path to a first brush system; engaging the mat with the first brush system; conveying the mat from the first brush system to a second brush system; engaging the mat with the second brush system; and conveying the mat away from the second brush system in a direction opposite a direction of the first brush system.

An objective of the invention is to provide a system for cleaning swamp mats that may be transportable to and from different locations, including remote work sites. An aspect of the invention is an apparatus transportable on a flat bed trailer, and that is highway portable; that is, transportable on a trailer down a roadway and in compliance with all Department of Transportation regulations.

Further, an objective of the invention is to provide a system for cleaning mats that is automated and that may save time over conventional mat washing systems. In recent times, different jurisdictions (e.g., from state to state) have started to closely regulate what is brought into their regulated boundary in order to curb any transfer of hazardous or non-native substance. Thus, as it is necessary to clean mats prior to transporting the mats, any time savings in cleaning mats may be appreciated for at least the reason that it may allow for mats to be more efficiently transported from one jurisdiction to another jurisdiction.

The above summary of the present invention is not intended to describe each illustrated embodiment, aspect, or every implementation or object of the present invention. The figures and detailed description that follow more particularly exemplify these and other embodiments and further aspects of the invention.

BRIEF DESCRIPTION OF THE DRAWINGS

The invention may be more completely understood in consideration of the following description of various embodiments of the invention in connection with the accompanying drawings, in which.

Figure 1:
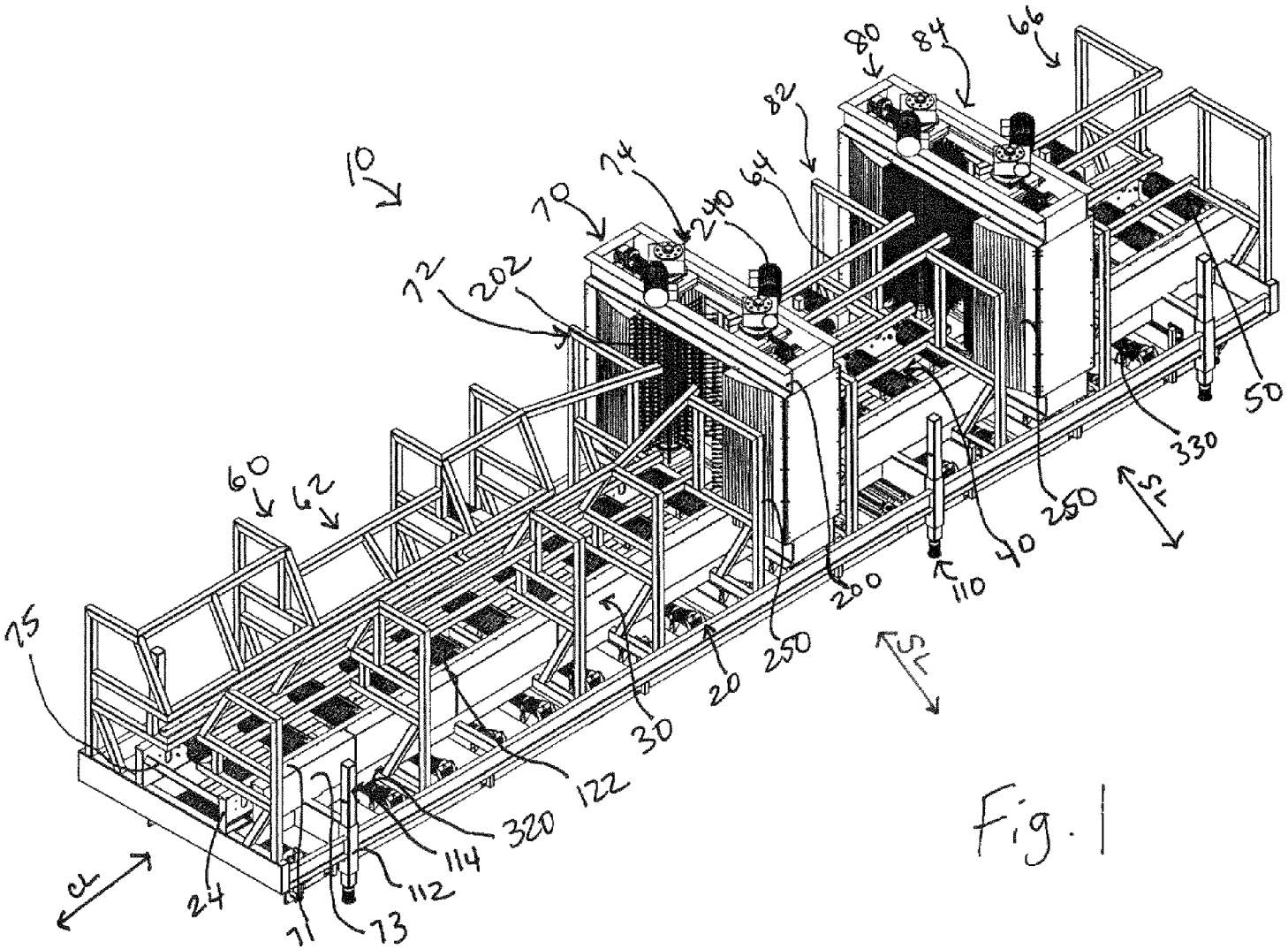
FIG. 1 is a perspective view of an embodiment of the invention.

While the invention is amenable to various modifications and alternative forms, specifics thereof have been shown by way of example in the drawings and will be described in detail. It should be understood, however, that the intention is not necessarily to limit the invention to the particular embodiments described. On the contrary, the intention is to cover preferred embodiments, modifications, equivalents, and alternatives falling within the spirit and scope of the invention and as defined by the appended claims.

DETAILED DESCRIPTION OF THE DRAWINGS

The subject inventive transportable system and methods of using the transportable system may take on numerous physical and methodical embodiments within the spirit of the invention and only preferred embodiments have been described in detail below, which are not meant to limit the scope and/or spirit of the invention.

A mat washer 10 of the invention may take many forms. Generally, mat washer 10, as seen in FIG. 1, may include a main frame 20, at least a first conveyor system 30, a rail system 60, a primary brush system 70 and a secondary brush system 80. Mat washer 10 may be operated by a control system (not shown) that may be located remotely or directly on mat washer 10. The control system may separately control speed and direction of conveyor systems, speed, directions and angles (i.e., tilt angles) of brush systems and any other feature of mat washer 10 that may be operated.

Figure 17:
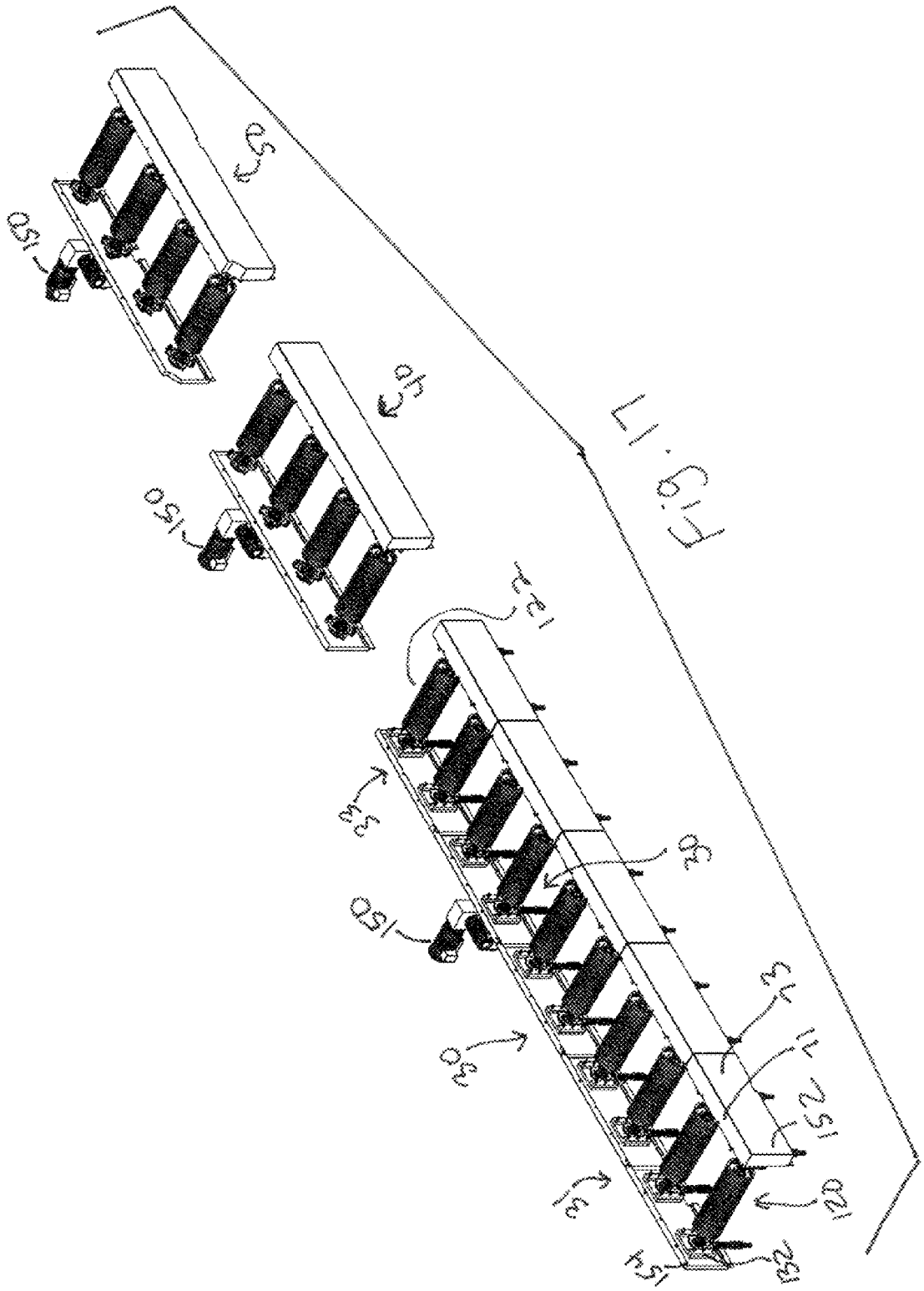
FIG. 17 is an exploded top-angled perspective view of a feature of an embodiment of the invention.

Mat washer 10 may include more conveyor systems than just the first conveyor system 30, as seen in FIGS. 1 and 17. For example, a second conveyor system 40 may be utilized between primary brush system 70 and secondary brush system 80. Further, a third conveyor system 50 may be utilized after secondary brush system 80. As depicted in FIG. 1, three different conveyor systems 30, 40, 50 are disclosed, however, it is contemplated that the three conveyor systems may be combined to form a single conveyor system that directs objects along mat washer 10 or there may be any number of conveyor systems utilized in mat washer 10 for conveying object along mat washer 10. Optionally, conveyor systems 30, 40 and 50 may include belts to further assist in transporting mats or any other objects along rollers 122 or the path of conveyors 30, 40 and 50. Such belts may include a v-angle design to define a trough for more efficient transport of materials and liquids. A 42 inch wide belt, for instance, would capture and convey a bulk of material.

Figure 16:
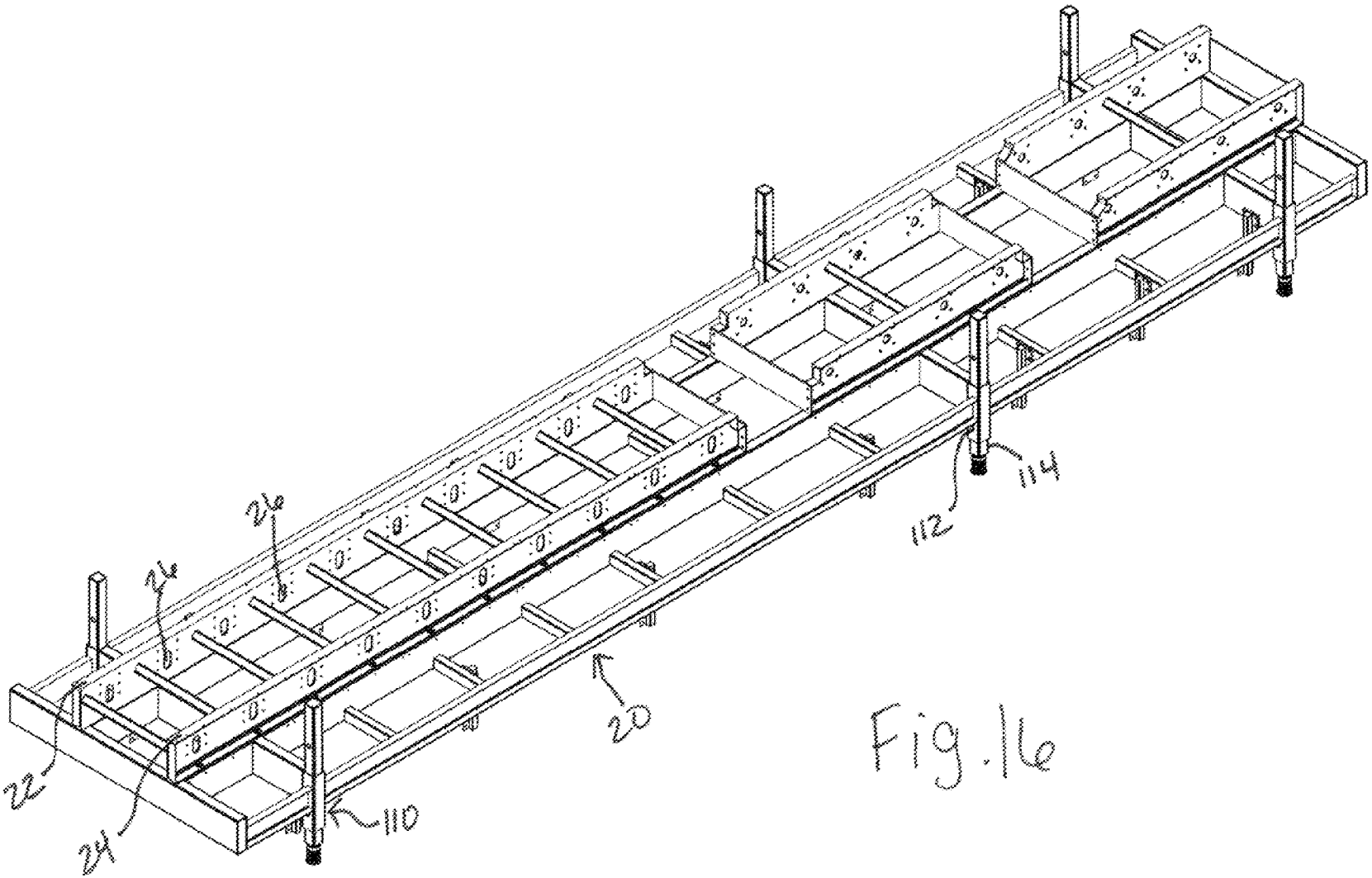
FIG. 16 is a top-angled perspective view of a feature of an embodiment of the invention.

Main frame 20, as depicted in FIGS. 1 and 16 may support, generally, the features of mat washer 10. Main frame 20 may be directly supported by a surface or may have a leg support assembly 110 attached thereto for supporting main frame 20 at or above the surface. Leg support assembly 110 may be adjustable. Main frame 20 may have a tube 112 that is capable of sliding up and down a shaft 114. Tube 112 may be able to lock into place at a desired location along the length of shaft 114. Tube 112 and shaft 114 fit together so that main frame 20 may slide vertically up and down above a surface. Further, tube 112 may be able to lock in place along shaft 114. Although a lock is not depicted, any lock commonly known to keep a piece of equipment in the same position relative to another piece of equipment may be utilized. For example, a linchpin lock or a button lock, commonly known in the art, may be used. As seen in FIG. 1 more than one leg support assembly 110 may be utilized. The number of leg support assemblies 110 may depend on any factors, but some considerations may include the appropriate balance of mat washer 10 or support for features included in mat washer 10.

Figure 11:
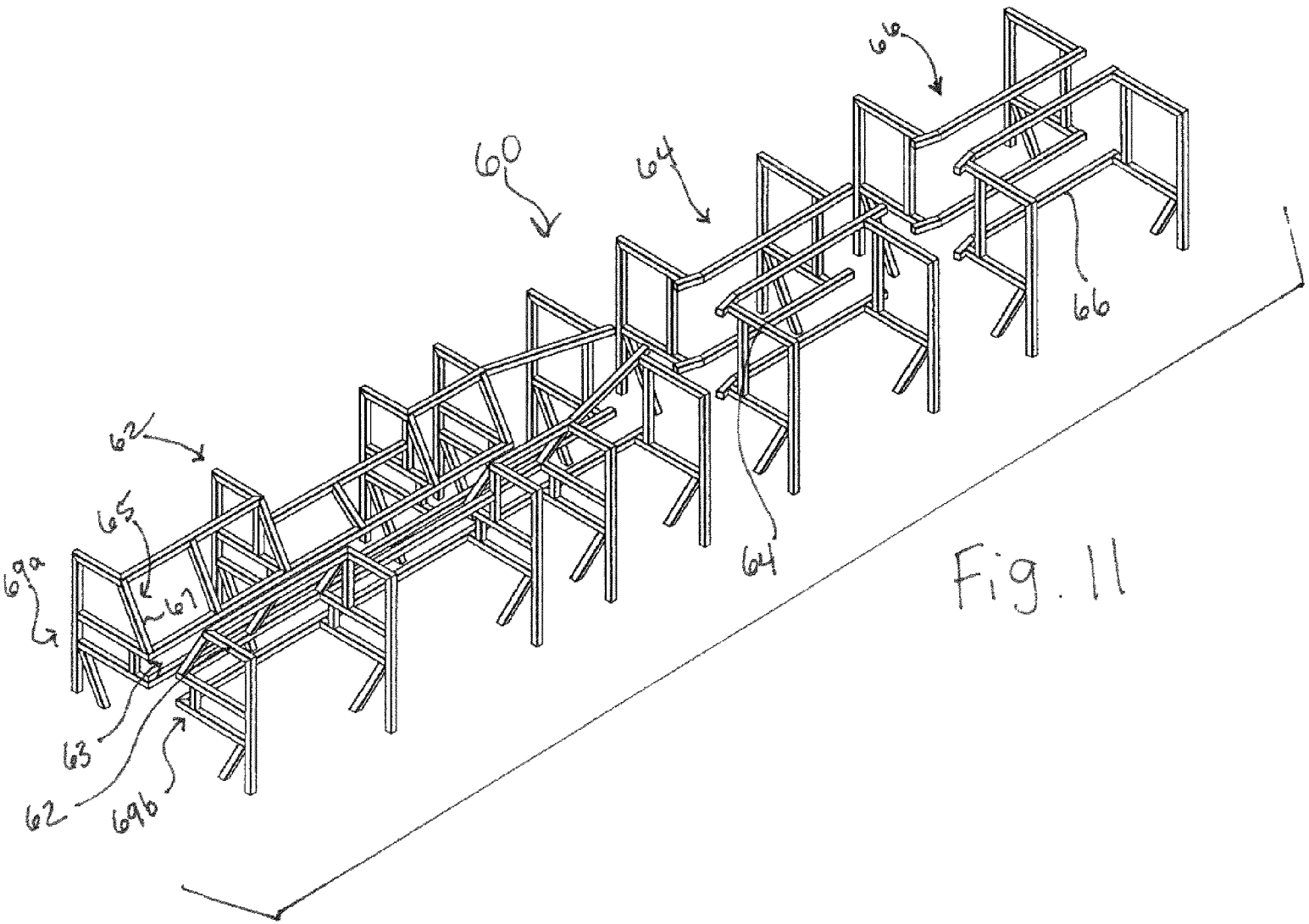
FIG. 11 is an exploded top-angled perspective view of a feature of an embodiment of the invention.
Figures 12, 13:
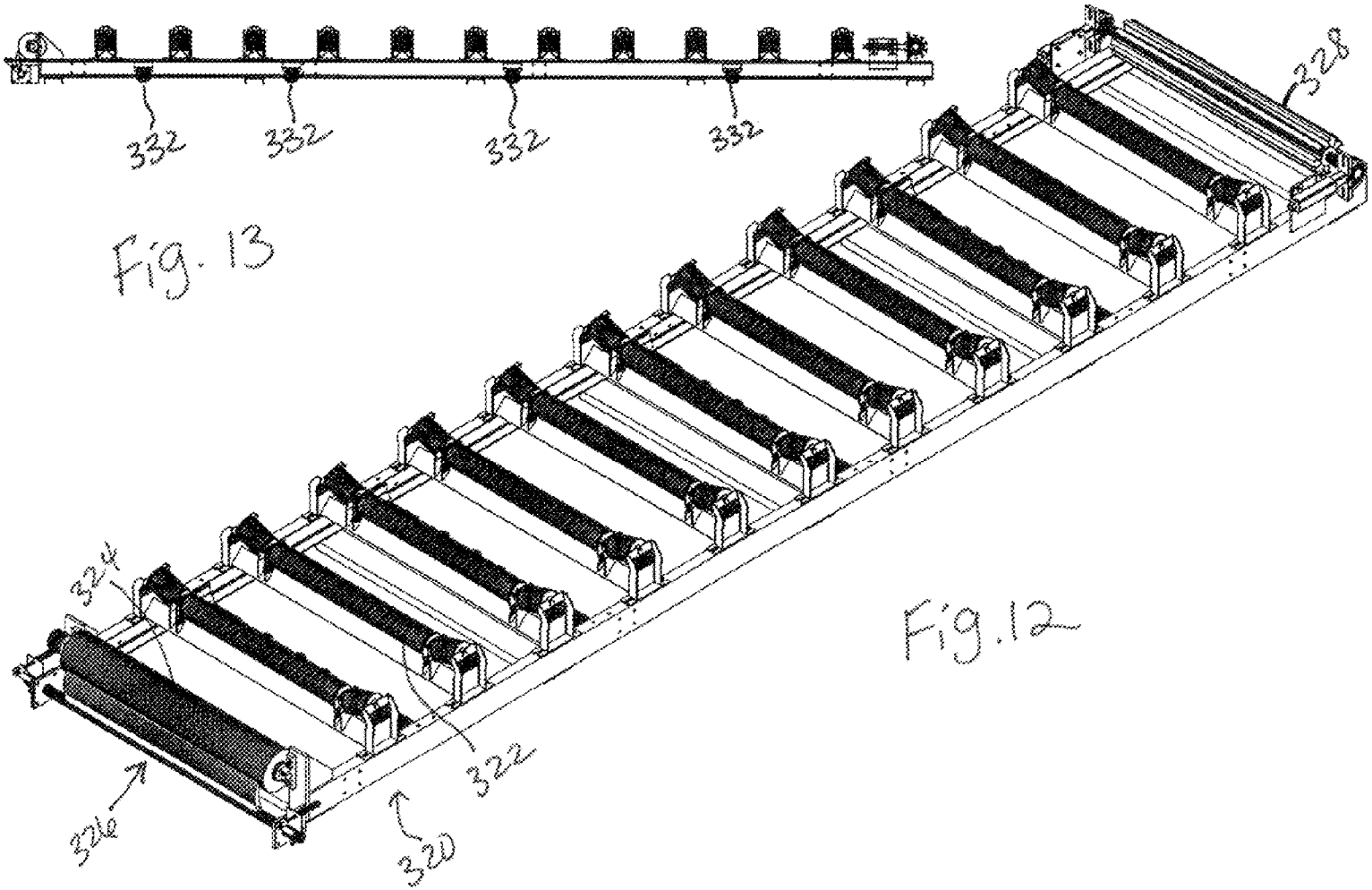
FIG. 12 is a top-angled perspective view of a feature of an embodiment of the invention.
FIG. 13 is a side plan view of a feature of an embodiment of the invention.
Figure 15:
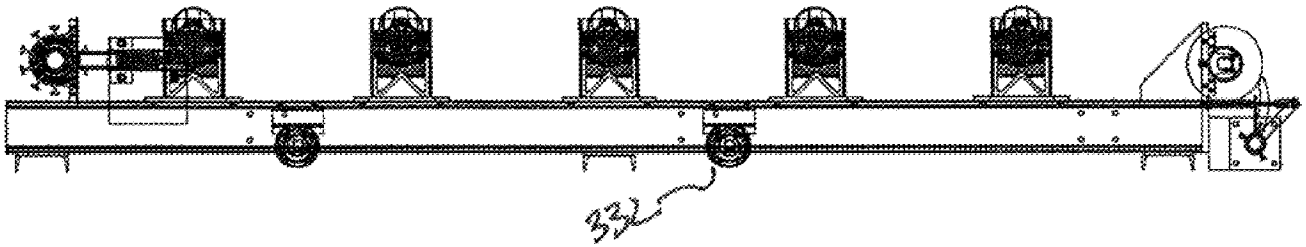
FIG. 15 is a side plan view of a feature of an embodiment of the invention.
Figure 14:
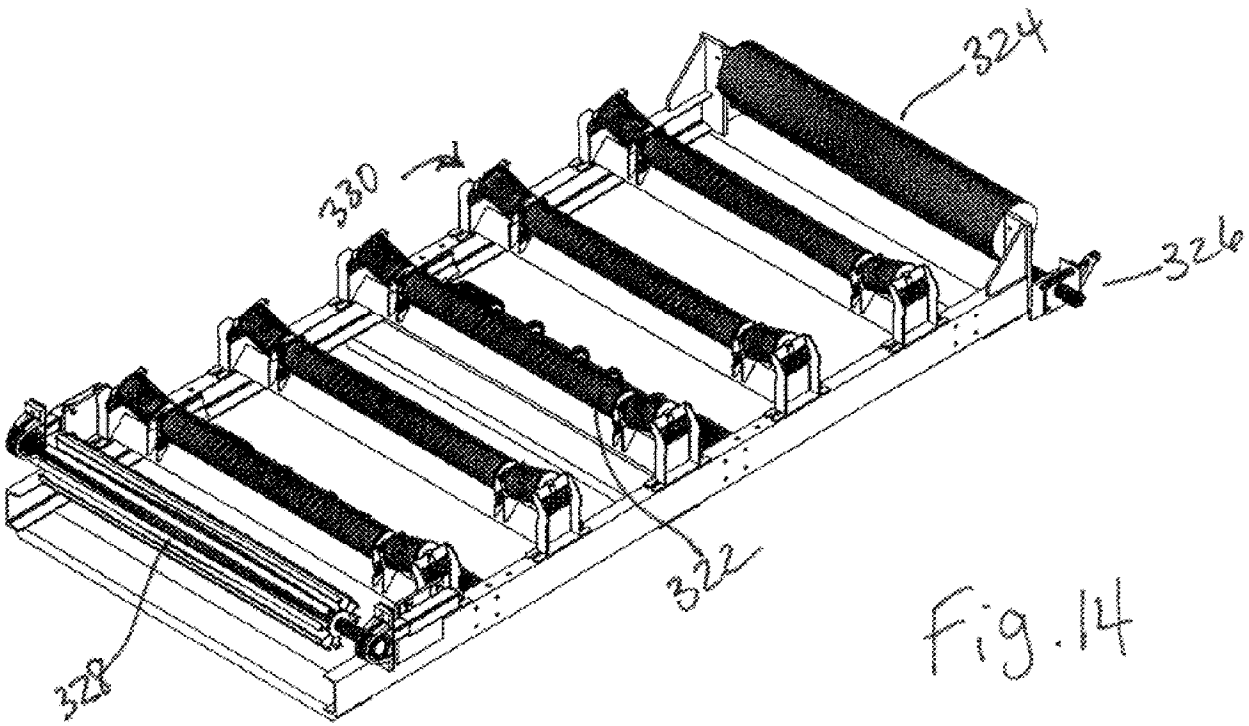
FIG. 14 is a top-angled perspective view of a feature of an embodiment of the invention.

Mat washer 10 may have a rail system 60, as in FIGS. 1 and 11, that is permanently or detachably connected to main frame 20. For example, rail system 60 may be attached to main frame 20 by using bolts, welding or any other connection method. Rail system 60 may be a single system spanning any length of mat washer 10 or it may comprise multiple sections of rails. For example, a first rail section 62 may span substantially from the location at which mats are inserted onto or into mat washer 10 until a first side of primary brush system 72, a second rail section 64 may span substantially from a second side of primary brush system 74 to a first side of secondary brush system 82 and a third rail section 66 may span substantially from a second side of the secondary brush system 84 to an end of mat washer 10. Rail system 60 may take any shape or shapes, but may at least be capable of partially guiding mats along a conveyor system path. Further, at least a portion of rail system 60 my have a beveled portion 65 to ease the insertion of mats onto or into mat washer 10. In one instance, beveled portion 65 is defined by an angled rail 67. Particularly, angled rail 67 is arranged in a non-vertical manner and provides rail system 60 with a relatively wide top opening to accommodate insertion of a mat. More particularly, opposing rail components, such as rail components 69*a*, 69*b*, which are symmetrical or mirror images of each other, each have a beveled portion 65. Opposing beveled portions 65 define a relatively wide opening as compared to a narrower channel opening 63. Further, the beveled portions 65 present an ever-increasing opening at further distances from main frame 20. The opposing beveled portions thus allow for more efficient insertion or placement of a mat, on edge, into channel opening 63 and onto conveyor system 30. A mat placed onto beveled portion 65 by a backhoe or other machinery tends to naturally slide into position and on edge; or if a mat is placed upon railing 62 on its side, or where the edge of the mat is not facing the ground, it may then be repositioned by dragging the mat to one side or the other and/or angling an edge toward beveled portion 65 to assist mat in standing on edge.

As depicted in FIGS. 1 and 17-20, conveyor systems 30, 40, 50 may be made from essentially the same parts or different parts and may convey along a conveying line CL. Conveyor systems 30, 40, 50 may convey in a single direction or multiple directions. In one aspect, conveyor systems 30, 40, 50 may comprise at least one spring roller assembly 120. Typically, however, a spring roller assembly 120 is most useful with conveyor system 30 which will receive the greatest wear due to mats being initially placed, or dropped, upon the conveyor 30. Spring roller assembly 120 may generally comprise a roller 122, a roller shaft 124, and a spring take up assembly 130. Roller shaft 124 may extend through roller 122 or may comprise multiple shafts that are attached to roller 122. Roller shaft 124 may extend through holes 126 (See FIG. 16) in main frame 20 and may then be attached to spring take up assembly 130. Spring take up assembly 130 may be located on an outside portion of main frame 20 and connected to an end of roller shaft 124. Spring take up assembly 130 may in turn be connected to main frame 20 on an outside portion of main frame 20. Further, spring take up assembly 130 may be connected to main frame 20 through any known connection means. For example, spring take up assembly 130 may be connected to main frame through a bolt connection or any other connecting means. Cross supports 75 may also be positioned between adjacent roller assemblies 120 and extend from main frame first side 22 to main frame second side 24 (or rail 73). Cross supports 75 are aligned below (i.e. 1 to 3 or more inches) a plane defined by the top portion of assemblies 120 (i.e., supports 75 do not have independent suspension and operate to resist downward movement of a mat and prevent assemblies 120 from bottoming out).

Figure 20:
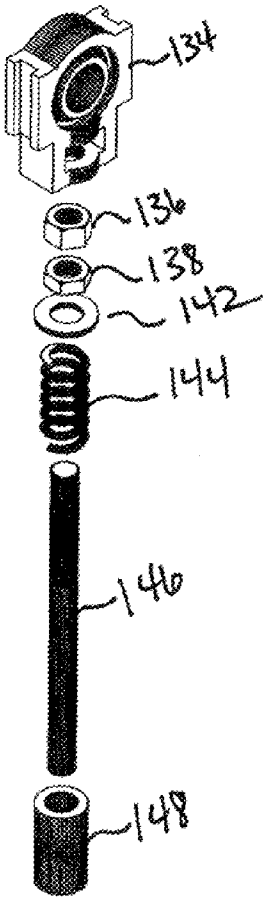
FIG. 20 is a top-angled perspective view of a feature of an embodiment of the invention.
Figure 19:
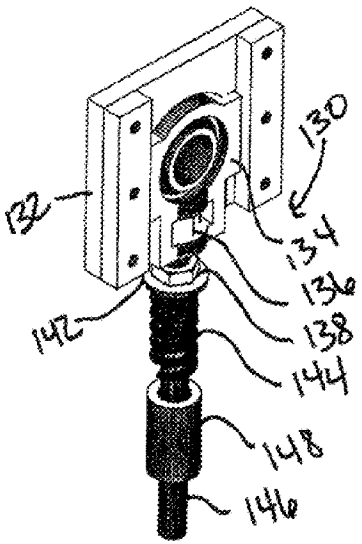
FIG. 19 is a top-angled perspective view of a feature of an embodiment of the invention.
Figure 18:
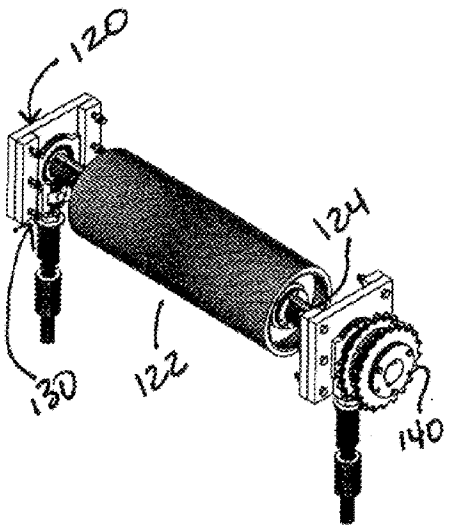
FIG. 18 is a top-angled perspective view of a feature of an embodiment of the invention.

In one aspect, spring take up assembly 130, as shown in FIGS. 19 and 20, comprises a take up mount plate 132, a take up shaft receiver 134, a first nut 136, a second nut 138, a washer 142, a spring 144, spring shaft 146 and a shim sleeve 148. Spring take up assemblies 130 may slidably and or rotatably engage each exterior end of roller shaft(s) 124 at take up shaft receiver 134 and then further attach to main frame 20 at take up mount plate 132. Take up shaft receiver 134 and take up mount plate 132 may be a single piece or multiple pieces adjustably connected. Take up mount plate 132 may be mounted to main frame 20 and may permanently or detachably and/or slidably engage take up shaft receiver 134.

Further, spring take up assembly 130 creates an independent suspension for each roller 122 and roller shaft 124 assembly in conveyor systems 30, 40, 50, and may create an independent suspension for each side of a roller 122 and roller shaft 124 assembly. Independent suspension of each roller 122 allows washer 10 increased durability. The weight of a mat dropped upon a roller 122 or rollers 122 is absorbed by springs 144, at least partially, to lessen the impacting force upon roller 122 that would occur absent such absorption. Holes 126 are somewhat elongated to accommodate for vertical motion of roller shafts 124. Seals are used to cover exposed gaps in holes 126 or take up assembly 130.

As depicted in FIG. 17, roller 122 may be driven through the power of a roller driver 150. Roller driver 150 may be an electrical and/or a mechanical driver or motor. Further, roller driver 150 may engage roller chain sprockets 140 (FIG. 18), which may engage roller shaft 124, and in turn, roller shaft 124 may turn roller 122 due to being integrally attached thereto. Roller driver 150 may engage roller chain sprockets 140 directly or by any engaging mechanism; for example, roller driver 150 may engage roller chain sprockets 140 with at least one chain (chain not shown for simplicity purposes). If each roller 122 were to have its own roller driver 150, sprockets 140 and chain(s) may not be required as each roller driver 150 may be directly attached to each roller shaft 124. For example, an electric roller driver may be attached to individual roller shafts 124 and independently drive each roller 122. Alternatively, each roller 122 may itself be an electrically activated roller.

Spring roller assemblies 120 of conveyors 30, 40, 50 may be covered by guards 152, 154 and a third guard (not shown). Roller 122 may be attached to roller shaft(s) 124 at a position between main frame first side 22 and main frame second side 24. Roller shaft(s) 124 may extend through main frame holes 26 and engage take up shaft receivers 134 at ends of roller shaft(s) 124 and at positions outside main frame first side 22 and main frame second side 24 (See FIG. 16). Roller chain sprockets 140 may connect to at least one end portion of roller shaft 124 at an outside position of main frame second side 24. First guard 152 may connected to main frame second side 24. First guard 152 may at least partially, if not substantially or completely, cover chain, roller chain sprockets 140, roller shaft 124 and spring take up assembly 130 on at least one side of the features and may do so for any purpose; for example, for the purpose of safety to operators and mechanics, prevention of water and debris from entering such spaces, and for endurance of mat washer 10. Second guard 154 may attach to a take up mount plate 132 and main frame first side 22. Second guard 154 attaches at least partially, if not substantially or completely, cover roller shaft 124 and spring take up assembly 130 on at least one side of the features and for any purpose; for example, for the purpose of endurance of mat washer 10 or safety of users. Further, a third guard may be utilized on the inside surfaces of main frame first side 22 and main frame second side 24 so as to cover main frame holes 26. Third guard may slide along with roller shaft 124 as it moves up and down in response to any force exerted on roller 122, including response forces from spring 144. First guard 152, second guard 154 and third guard may be made of any material capable of at least partially guarding the insides of an object. For example, first guard 152 may be made of a metal, second guard 154 may be made of a resilient rubber and third guard may be made of a hard plastic. Further, guards 152, 154 and third guard, along with main frame 20 may substantially, if not completely, enclose take up mount plate 132 and take up shaft receiver on at least three sides.

Figure 2:
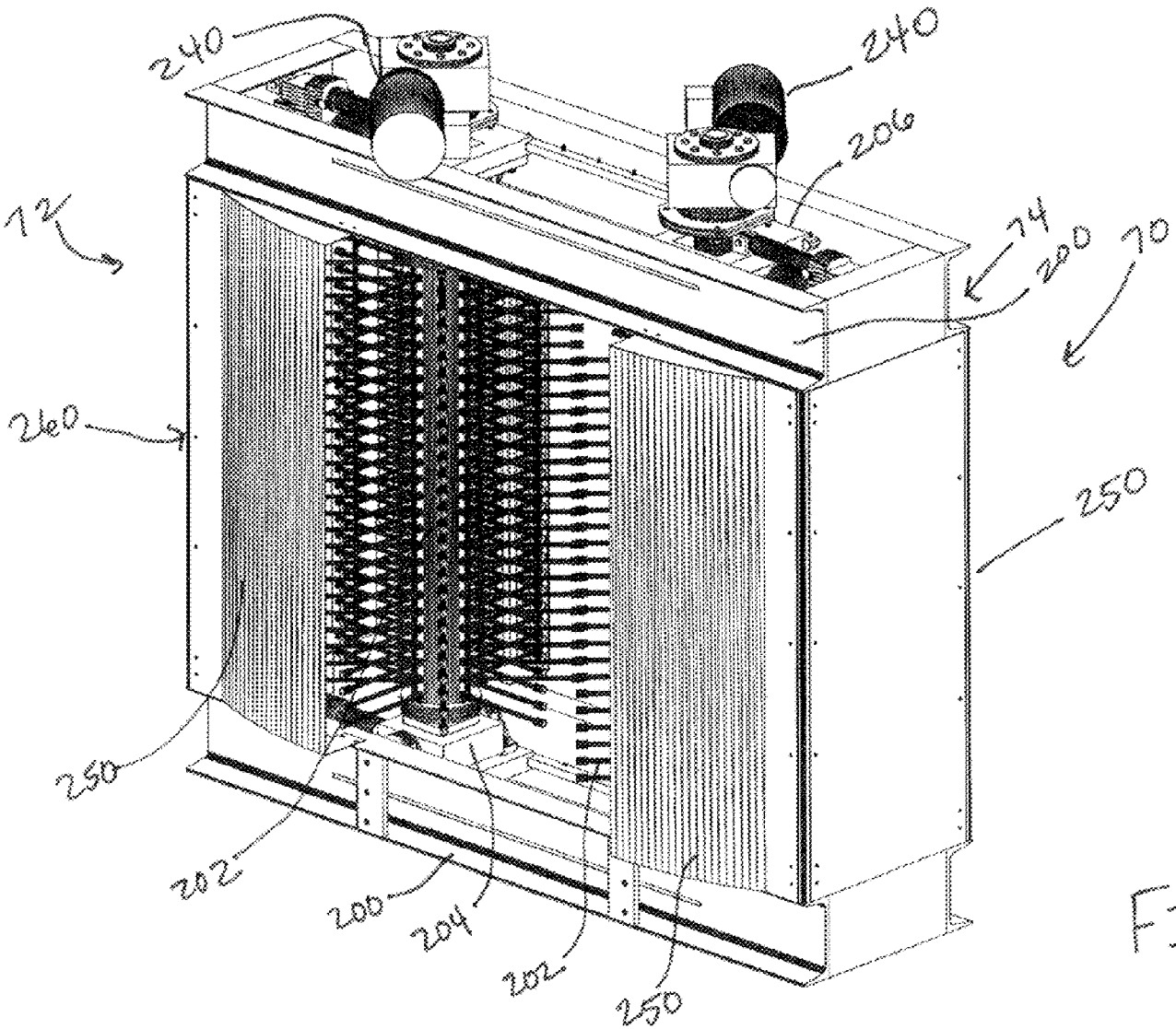
FIG. 2 is a perspective view of a feature of an embodiment of the invention.
Figure 3:
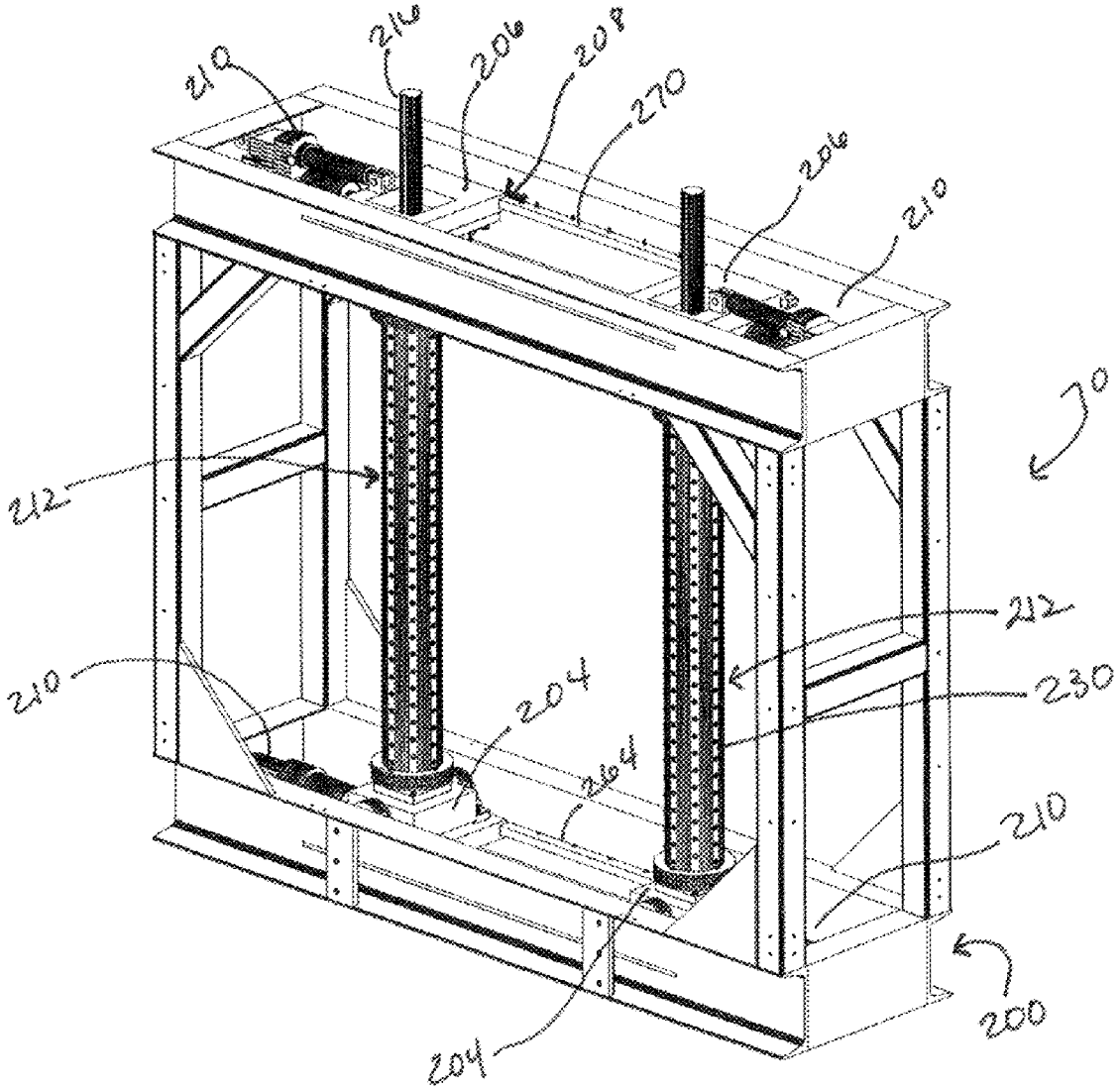
FIG. 3 is a perspective view of a feature of an embodiment of the invention.
Figure 7:
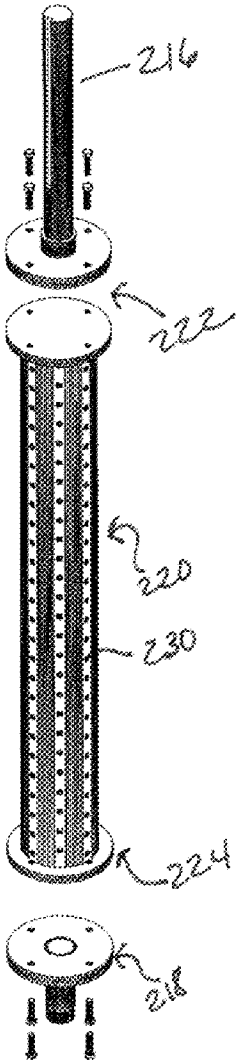
FIG. 7 is an exploded top-angled perspective view of a feature of an embodiment of the invention.
Figure 6:
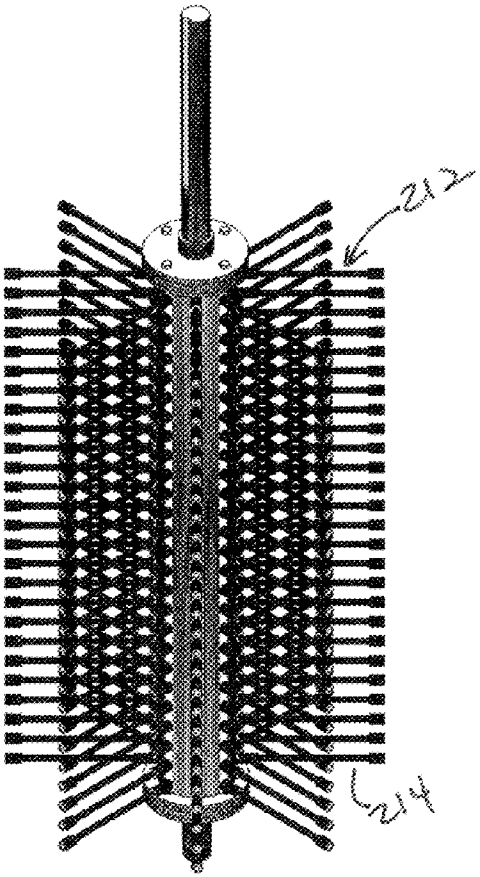
FIG. 6 is a top-angled perspective view of a feature of an embodiment of the invention.

As shown in FIGS. 1-3, primary brush system 70 may comprise a primary frame assembly 200, a cable brush drum assembly 202, lower bearing assembly 204, upper bearing assembly 206, slide assembly 208, actuator 210, cable drum assembly 212, cable brushes 214, brush drive assembly 240 and splash shield 250. Cable drum assembly 212, as shown in FIGS. 6 and 7, may comprise a brush drum upper hub assembly 216, a brush drum lower hub assembly 218 and a brush drum body 220. Brush drum upper hub assembly 216 may connect to a first end of brush drum body 222 and brush drum lower hub assembly 218 may connect to a second of brush drum body 224.

Figure 8:
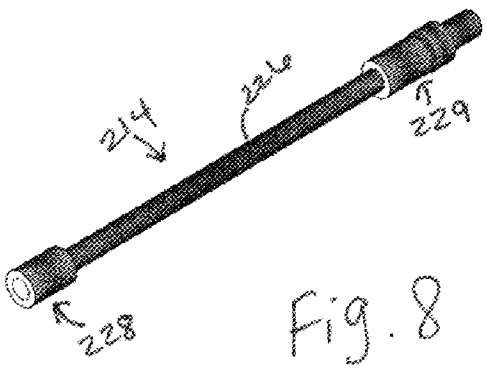
FIG. 8 is a top-angled perspective view of a feature of an embodiment of the invention.

As seen in FIGS. 6-8, cable brushes 214 may be made of steel or any other resilient, strong material. A cable 226 made of braided wire having steel strands may be used. Cable brushes 214 preferably have bolts or thimbles 228 located at a first end of cable 226. A bolt or thimble 228 preferably has a radius or cross-section that is greater than a radius or cross-section of cable 226. Preferably bolt or thimble 228 operates as a weight at the end of cable 226 to impart a force and to beat upon a mat as cable brush 214 spins or rotates. Thimbles 228 may be configured in a variety of shapes. In one aspect thimble 228 may have an end substantially abutting an end of cable 226. In another aspect thimble 228 may be generally cylindrical so as to receive cable 226. Thimbles 228 may be of any size; for example, thimbles 228 may have a larger diameter than cable 226 and may be more rigid than a cable 226 which cable may be resilient. Further, a second thimble 228 may be located on cable 226 some distance away from the first thimble 228. In addition second thimble 229 may be located some distance from a second end of cable 226. As mentioned above, cables 226 and thimbles 228 may be made out of steel or other materials having strong and resilient properties. Preferably thimble 228 has a mass density higher than a mass density of cable 226. Thimbles 228 may be attached to cables 226 in any manner; for example, through a weld connection or a cable-tie or clamping connection, or other secure connection. Further, cable brushes 214 may be connected to brush drum body 220 through body holes 230 by any connection means.

Figure 21:
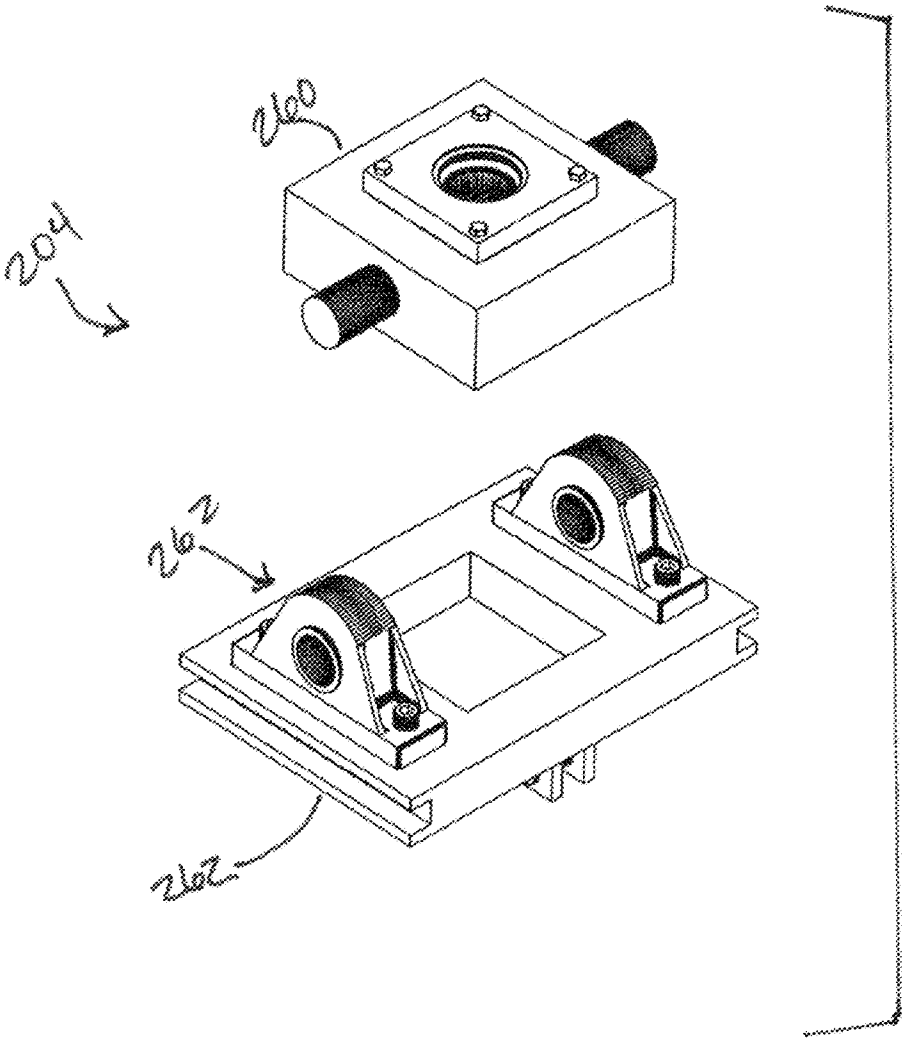
FIG. 21 is an exploded top-angled perspective view of a feature of an embodiment of the invention.

As seen in FIG. 21, lower bearing assembly 204 comprises a lower bearing housing assembly 260 and a lower slider assembly 262. Lower bearing assembly 204 may comprise any assembly capable of engaging brush drum lower hub assembly 218 (FIG. 7) which allows for angled movement of cable brush drum assembly 202. Lower bearing assembly 204 may slide along lower slide ridge 264. When combined with primary frame assembly 200 and cable brush drum assembly 202, lower bearing assembly 204 may continue to slide along lower slide ridge 264 and allow for angled movement of cable brush drum assembly 202.

Figure 23:
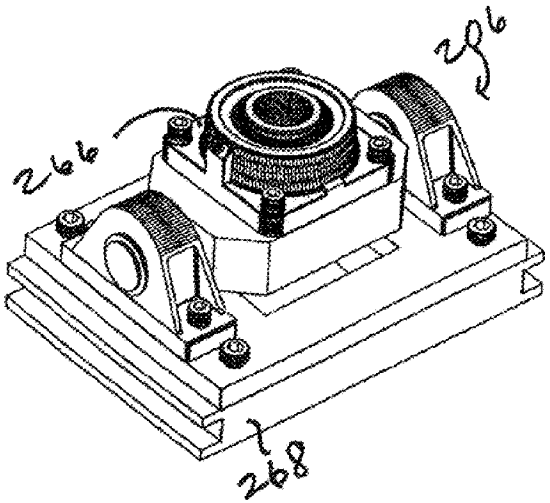
FIG. 23 is a top-angled perspective view of a bottom of a feature of an embodiment of the invention.
Figure 22:
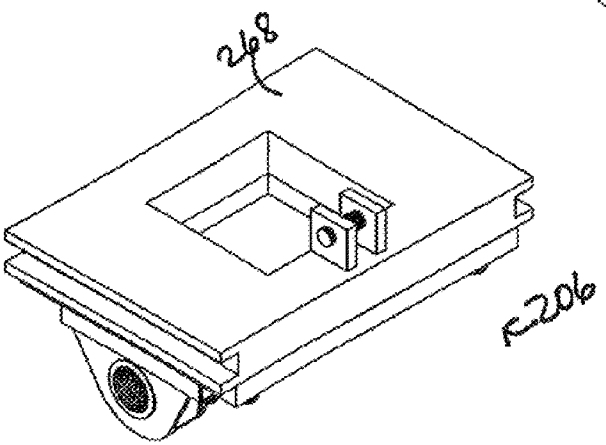
FIG. 22 is a top-angled perspective view of a feature of an embodiment of the invention.
Figure 24:
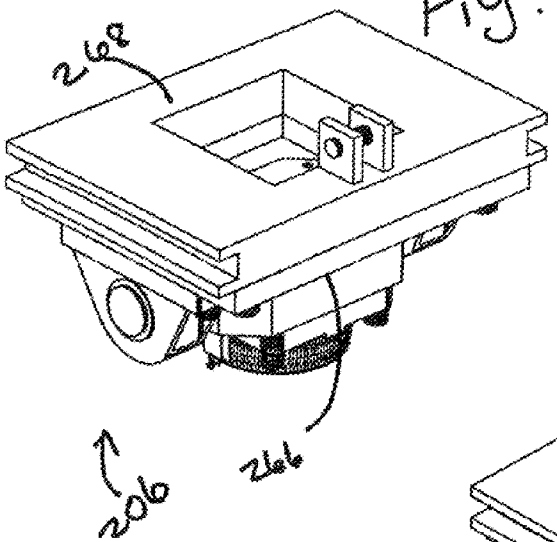
FIG. 24 is a top-angled perspective view of a top of a feature of an embodiment of the invention.

As seen in FIGS. 22-24, upper bearing assembly 206 may comprise an upper bearing block assembly 266 and an upper slider assembly 268. Upper bearing assembly 206 may comprise any assembly capable of engaging brush drum upper hub assembly 216 and may allow for angled movement of cable brush drum assembly 202. Upper bearing assembly 206 may slide along upper slide ridge 270. When combined with primary frame assembly 200 and cable brush drum assembly 202, upper bearing assembly 206 may continue to slide along upper slide ridge 270 and allow for angled movement of cable brush drum assembly 202.

Upper bearing assembly 206 and lower bearing assembly 204 may engage actuators 210. Actuators 210 may be any type of actuator; for example, a hydraulic actuator. Such actuators may assist in sliding movement of lower bearing assembly 204 and upper bearing assembly 206. Further, brush drum upper hub assembly 216 extends through upper bearing assembly 206, and is slidably engaged therewith. When upper bearing assembly 206 or lower bearing assembly 204 slide, cable brush drum assembly 202 may angle. Brush drum assembly 202 may also maintain a generally vertical orientation where assembly 204 and assembly 204 are vertically aligned. A pair of drums 212 may also be drawn closer or farther from each other to achieve a desired gap through which a mat is conveyed. Since each bearing assembly 206, 204 is independently adjustable, a variety of angles, gaps and configurations can be achieved in order to accommodate cleaning of a variety of types, sizes and styles of mats.

Brush driver assembly 240 (FIG. 4) may engage brush drum upper hub assembly 216 at a position at or nearly above or above a top of primary frame assembly 200 and may be an electrical or mechanical or any other type of driver. As there may be more than one cable drum assembly 212 there may be multiple brush driver assemblies 240 that engage brush drum upper hub assemblies 216. Brush driver assembly 240 may be any type of driver assembly.

Within primary frame assembly 200, brush drum upper hub assembly 216 engages upper bearing assembly 206 and brush drum lower hub assembly 218 engages lower bearing assembly 204. Each bearing assembly 216, 218 is in communication with an actuator 210. Further, brush drive assembly 240 engages brush drum upper hub assembly 216. Yet further, primary brush system 70 may utilize splash shield assemblies 250 for any purpose; for example, for the purpose of blocking debris from flying off mats as cable brushes 214 contact a mat's surface.

Figure 4:
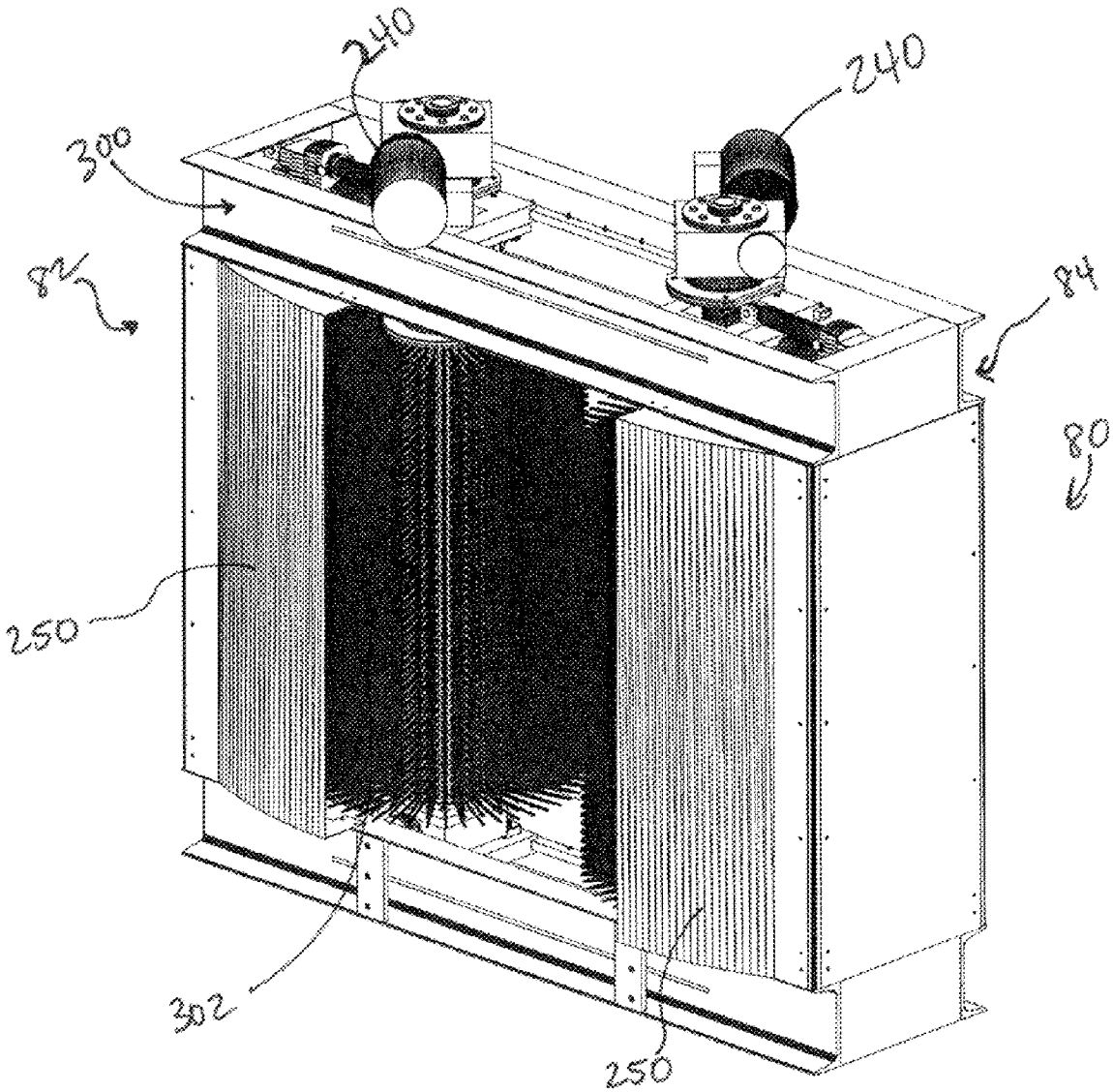
FIG. 4 is a top-angled perspective view of a feature of an embodiment of the invention.
Figure 5:
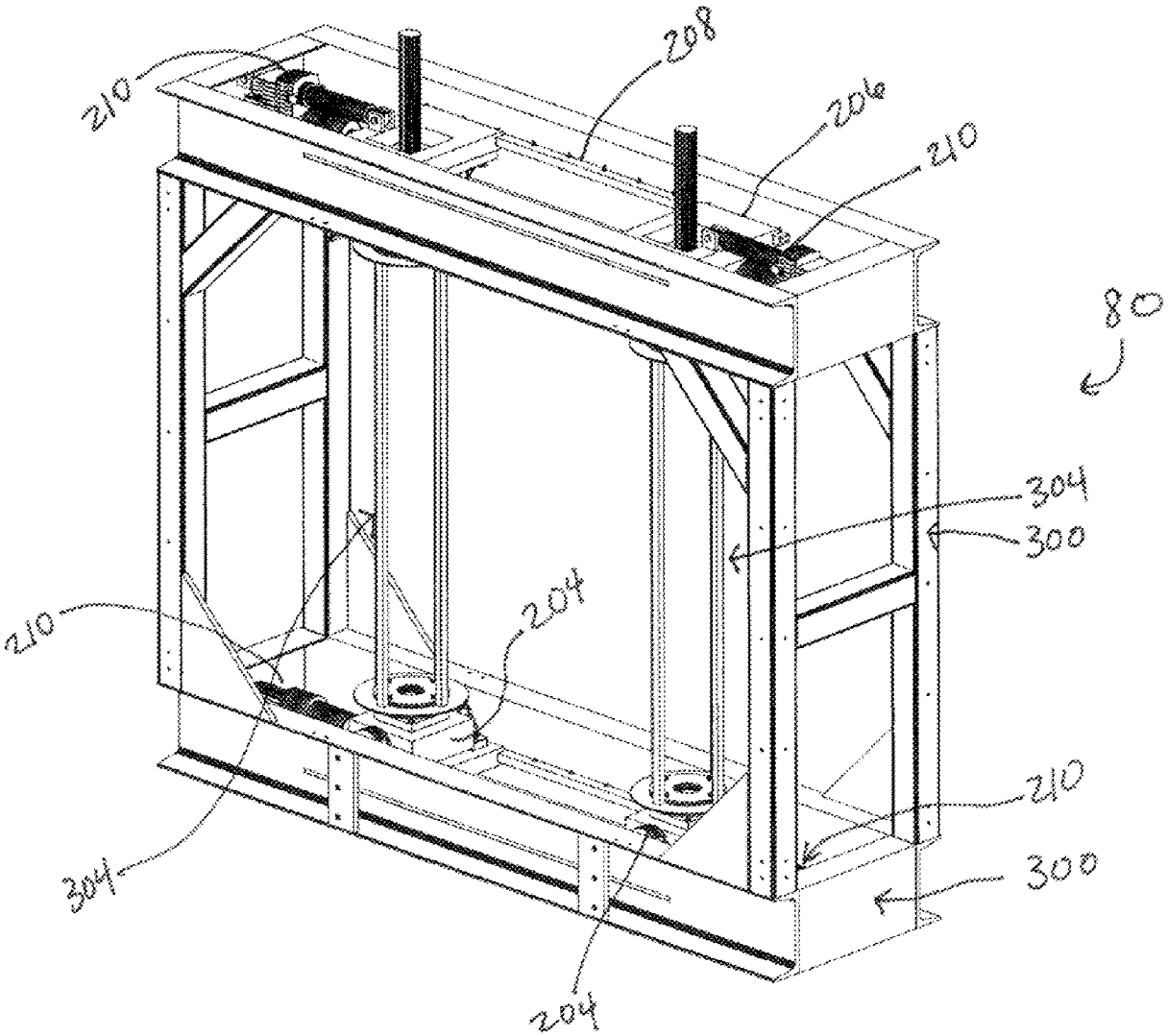
FIG. 5 is a top-angled perspective view of a feature of an embodiment of the invention.
Figure 10:
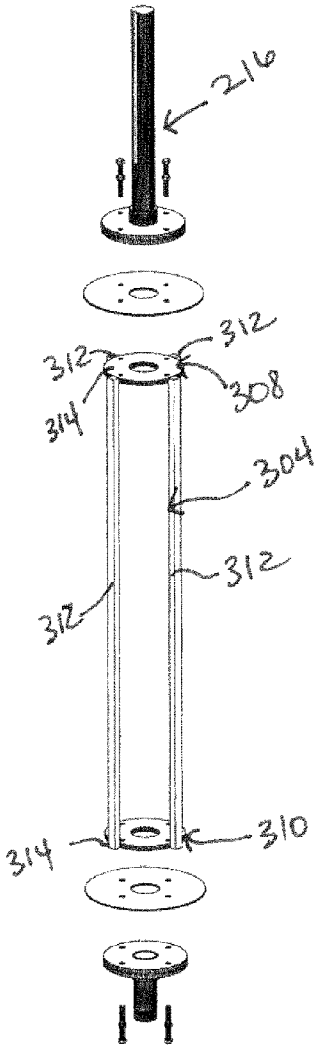
FIG. 10 is an exploded top-angled perspective view of a feature of an embodiment of the invention.
Figure 9:
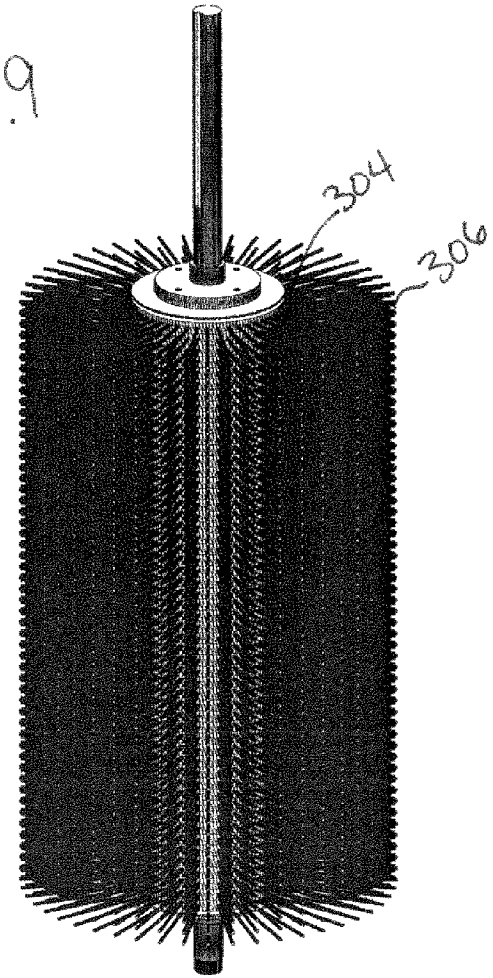
FIG. 9 is a top-angled perspective view of a feature of an embodiment of the invention.

As seen in FIGS. 1, 4 and 5, secondary brush system 80 may comprise a secondary frame assembly 300, a fiber brush drum assembly 302, as seen in FIGS. 9 and 10, lower bearing assembly 204, upper bearing assembly 206, slide assembly 208, actuator 210, fiber drum body 304, brush wafers 306, drive assembly 240 and splash shield 250. Fiber brush drum assembly 302 comprises a brush drum upper hub assembly 216 (FIG. 10), a brush drum lower hub assembly 218 and a fiber drum body 304. Brush drum upper hub assembly 216 connects to a first end of fiber drum body 308 and brush drum lower hub assembly 218 may connect to a second end of fiber drum body 310. Fiber drum body 308 may be of any elongated body device or apparatus. For example, fiber drum body 308 may comprise a single or multiple elongated fiber body bar(s) 312 that may engage a fiber body plate 314 at each end of fiber body bar 312.

Secondary brush system 80 may utilize many of the same parts or different parts as primary brush system 70 utilizes. Secondary brush system 80 and primary brush system 70 may be differentiated by at least having different drum assemblies 302, 202, respectively. The independently driven drum assemblies may be rotated clockwise or counter-clockwise as desired. Further, secondary brush system 80 may utilize splash shield assemblies 250 for any purpose; for example, for the purpose of blocking debris or water from flying off mats or out of the washer as brush wafers 306 contact a mat's surface.

Brush wafers 306 may be made from a ring having fibers extending therefrom. The fibers may be made from a natural or unnatural resilient material. Generally, brush wafers 306 may be stacked on top of one another so as to extend from second end of fiber drum body 310 to first end of fiber drum body 308. For at least the purposes of stiffening the fiber brushes and prolonging the life of the brush wafers 306, brush wafers 306 comprising metal fiber or other rigid material may be inserted between brush wafers 306 having fibers made of an unnatural mater (e.g., plastic).

As seen in FIGS. 12-15, mat washer 10 may also include discharge conveyors. For example, mat washer 10 may include a dry discharge conveyor 320 and a wet discharge conveyor 330. Generally, discharge conveyors 320, 330 may be made from the same or similar parts or may be made from different parts. Discharge conveyors 320, 330 may include idle rollers 322, a belt (belt not shown for simplicity purposes), driver roller 324, belt cleaner 326, wing pulley 328, return idle rollers 332 and any other device known in the art to be used for or in connection with conveyors. Wing pulley 328 assists in removal of unwanted debris, such as rocks or other materials, from being positioned between pulley and the belt (i.e., the gap structure of wing pulley 328 allows for the natural removal of such debris to exit an end of the pulley as is known in the art). Discharge conveyors 320, 330 may be located any where in connection with mat washer 10; for example, discharge conveyors 320, 330 may be located generally below spring roller assemblies 120. Further, a vertical order of certain elements of mat washer 10 may include discharge conveyors 320, 330 generally on a bottom, primary brush system 70 and secondary brush system 80 generally on a top, with spring roller assemblies 120 generally between discharge conveyors 320, 330 and brush systems 70, 80.

Dry discharge conveyor 320 may be generally located from a front end of mat washer 10 and may extend toward and to at least primary brush system 70. Dry discharge conveyor 320 may have many purposes, and one of those many purposes may include the purpose of catching dirt and other material released from mats and caused by primary brush system 70. Dry discharge conveyor 320 may move in any direction, including a direction opposite the direction the mats are conveyed through mat washer 10. As brush system 70 operates, debris, such as dirt or mud or other material is beat from or brushed from a mat and falls downward onto conveyor 320 for removal.

Wet discharge conveyor 330 may be generally located from secondary brush system 80 and may extend toward and to at least a back end of mat washer 10. Wet discharge conveyor 330 may have many purposes, and one of those many purposes may include the purpose of catching dirt and water and other material released from mats caused by the mats interacting with secondary brush system 80. Wet discharge conveyor also catches liquid that is introduced onto a mat during a washing event, such as liquid sprayed upon a mat at the secondary brush system 80. Wet discharge conveyor 330 may move in any direction, including the same direction the mats are conveyed through mat washer 10.

Mat washer 10 may be used with many methods to clean mats of any type. For example, mat washer 10 may be transported, via a tractor trailer for instance, to a remote location or any other location where mats may be used for a construction purpose. Mat washer 10 preferably has proportions which allow for transportation on a trailer. In one aspect, washer 10 is approximately 40 feet in length, approximately eight feet in width, and approximately eleven to twelve feet in height. The height is adjustable due to the leg support assemblies 110. In one aspect washer 10 is placed on a 48 foot step-deck trailer; the lower deck portion of the trailer measures approximately 40 feet to accommodate support of washer 10. As such a common trailer may be used for transport, without the need for special permits or wide load hauling, etc. and complies with department of transportation regulations. Mat washer 10 may be lifted onto a flat bed by any known means, which may include the use of a crane system.

Figure 25:
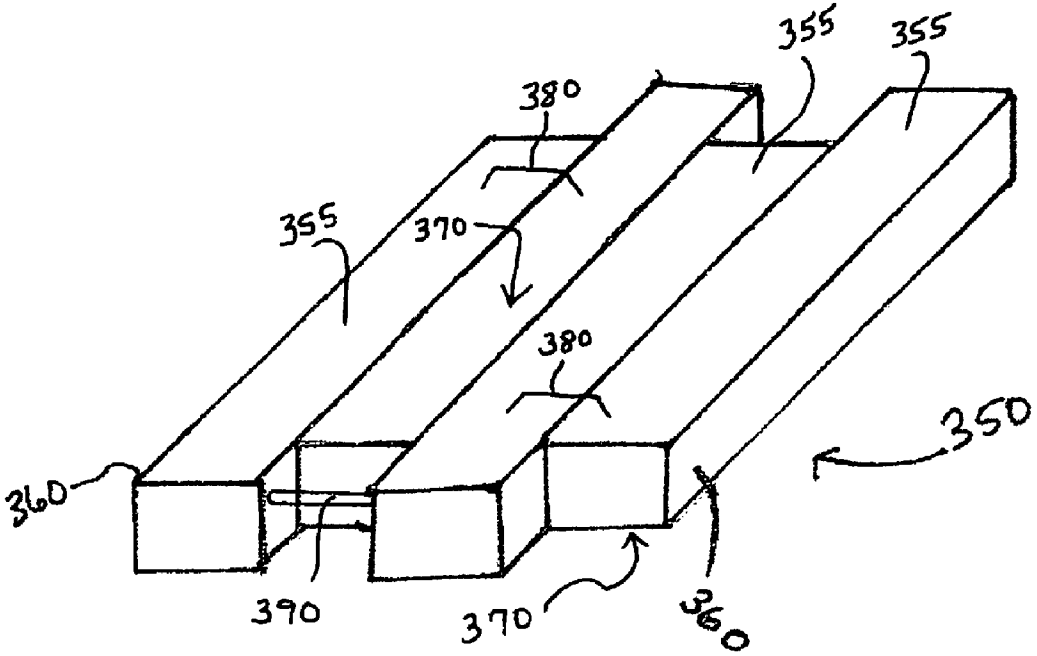
FIG. 25 is a top-angled perspective view of a swamp mat known in the art.

Once mat washer 10 is at a location where mats are in need of washing, mats may be inserted onto spring roller assemblies 120 at a front or first end of mat washer. A mat located at these locations is commonly known as a swamp mat 350 (as depicted in FIG. 25). A swamp mat 350 is typically an assembly of wooden segments 355, bound together by a rod or pin or other connector. A hook 380 or extending rod 390 is often included as part of a mat so that a crane or backhoe may grasp and lift a mat. A swamp mat 350 typically has a swamp mat edge 360 which has a surface area that is substantially less than the surface area of a swamp mat side 370. As shown in FIG. 25, swamp mat 350 is lying flat on one of its sides 370 while an edge surface 360 is oriented generally vertically. The unwashed mats may be inserted into mat washer 10 via any means. Such means may include a swing-boom crane 400 or backhoe. The same or similar means may be used to remove a washed mat from mat washer 10. To further assist in the insertion of mats 350, rail system 60 may have a beveled portion for the purpose of funneling mats 350 into mat washer 10.

Rail system 60 may be utilized to keep mats 350 in an upright position on its edge 360 and help direct mats 350 into primary brush system 70. Mats 350 may be conveyed along mat washer 10 via the driven spring roller assemblies 120. Due to the weight of a mat 350, the friction between mat 350 and rollers 122 and the drive of the rollers 122, mat 350 may be conveyed through mat washer 10. The weight of a mat 350 may vary, however, a mat 350 weighing several hundred pounds is typical. Mats having weights of several hundreds of pounds, and sometimes even into the thousands of pounds, may be expected to be washed in the present apparatus. Heavy equipment such as cranes and end-loaders are used to lift and transport the mats on to and/or off from the apparatus (trailers are contemplated for use to transport the mats to the location of the portable apparatus for washing.

In operation of one aspect, mat 350 is placed on conveying system 30 conveying along a conveying line, generally shown as line CL (FIG. 1). Mat 350 is placed on its mat edge 360. Conveying system 30 includes a first end 31 and a second end 33 (FIG. 17). Mat 350 first encounters primary brush system 70 having cables 226. An alignment roller or pair of rollers may be positioned adjacent first side of primary brush system 72 to help guide mat 350 into primary system 70. Alignment rollers may rotate about a generally vertical axis, and operate to feed or align mat 350 along centerline CL. Primary brush system 70 is position downstream first end 31 (i.e., along line CL and toward second end 33). Preferably, brush system 70 is positioned at least partially downstream conveyor system 30. Primary brush system 70 operates to remove large (or small) chunks of foreign material from the mats 350 (foreign material may be any material that is not originally a part of the mat). Removing large chucks of foreign material from the mats 350 prior to the mats 350 reaching secondary brush system 80 may work to conserve water, as less water may be required to wash the mats 350 at secondary brush system 80. Further, as foreign material such as dirt or mud is removed prior to secondary brush 80, less water is used for cleaning. Generally, cable brushes 214 are spun in any direction, for example, a direction opposite a direction the mats 350 are moving, and the cable brushes 214 may contact the mats 350 to remove pieces of foreign material. Discharge conveyor 320 may then collect the foreign material that has been released from the mat and convey the foreign material out of mat washer 10.

A mat 350 may then be conveyed to secondary brush system 80. Secondary brush system 80 is positioned downstream from primary brush system 70. Brush system 80 may work to remove remaining foreign material that was not removed by the primary brush system 70. Secondary brush system 80 may spray water on the mats 350 and may contact the mats 350 with brush wafer 306. Generally, brush wafers 306 are spun in any direction, for example, a direction opposite the direction the mats 350 are moving, and the brush wafers 306 and water may contact the mats 350 to remove pieces of foreign material. Wet discharge conveyor 330 may then collect released foreign material, water, mud and other material that has been released from the mats 350 and convey that material and water out of mat washer 10.

Brush systems 70, 80 may have many unique features. For example, the brush drums 220, 304 of brush system may be adjusted in directions perpendicular to the direction of mat transport so as to tilt in and out and may form different shapes including V-shapes and A-shapes, or angled/slanted parallel shapes. Further, brush systems 70, 80 may be capable of moving closer together for purpose of creating greater tension against mat. Yet further, brush systems 70, 80 may spin in any direction. All functions of brush systems 70, 80 may be controlled by a control system that may be located remotely with respect to main frame 20.

After mat 350 is conveyed through secondary brush system 80 the mat 350 is generally conveyed to an end of mat washer 10 and removed from the transportable device. Further, generally, while at rest and while in use, all systems of mat washer 10 may maintain their in-line position with respect to main frame 20 of mat washer 10 and the mats 350 are conveyed through the systems.

Multiple primary brush systems 70 or secondary systems 80 may be utilized on washer 10 in order to provide additional brushing if needed. Further, the direction of travel of a mat may be reversed such that it travels upstream on the conveyors in order to be re-brushed or rewashed. Yet preferably a mat is removed from washer 10 and replaced for rewashing if needed or desired in order to maintain a steady flow of movement in a single conveying direction as possible.

A separate brush system or systems may be included to wash mat edge or edges 360. Such separate system may utilize similar brush system as described herein.

Figure 26:
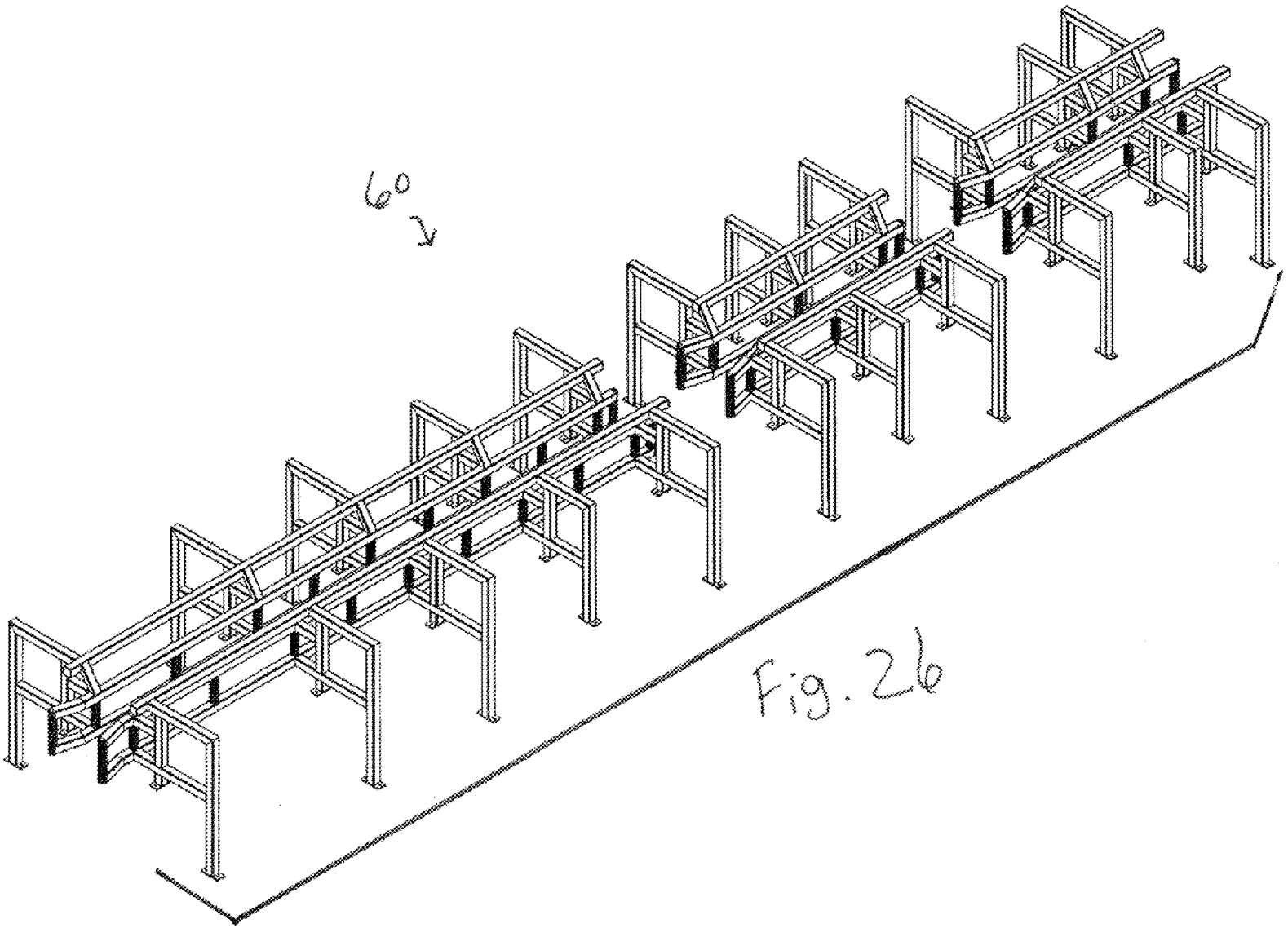
FIG. 26 is an exploded perspective view of a further aspect of a rail system of the present invention.

FIG. 26 depicts a further aspect of rail system 60. Rail system 60 may include support feet 61 which connect to a top portion 71 of rail 73. Use of feet 61 provides further stability to system 60.

Figure 27:
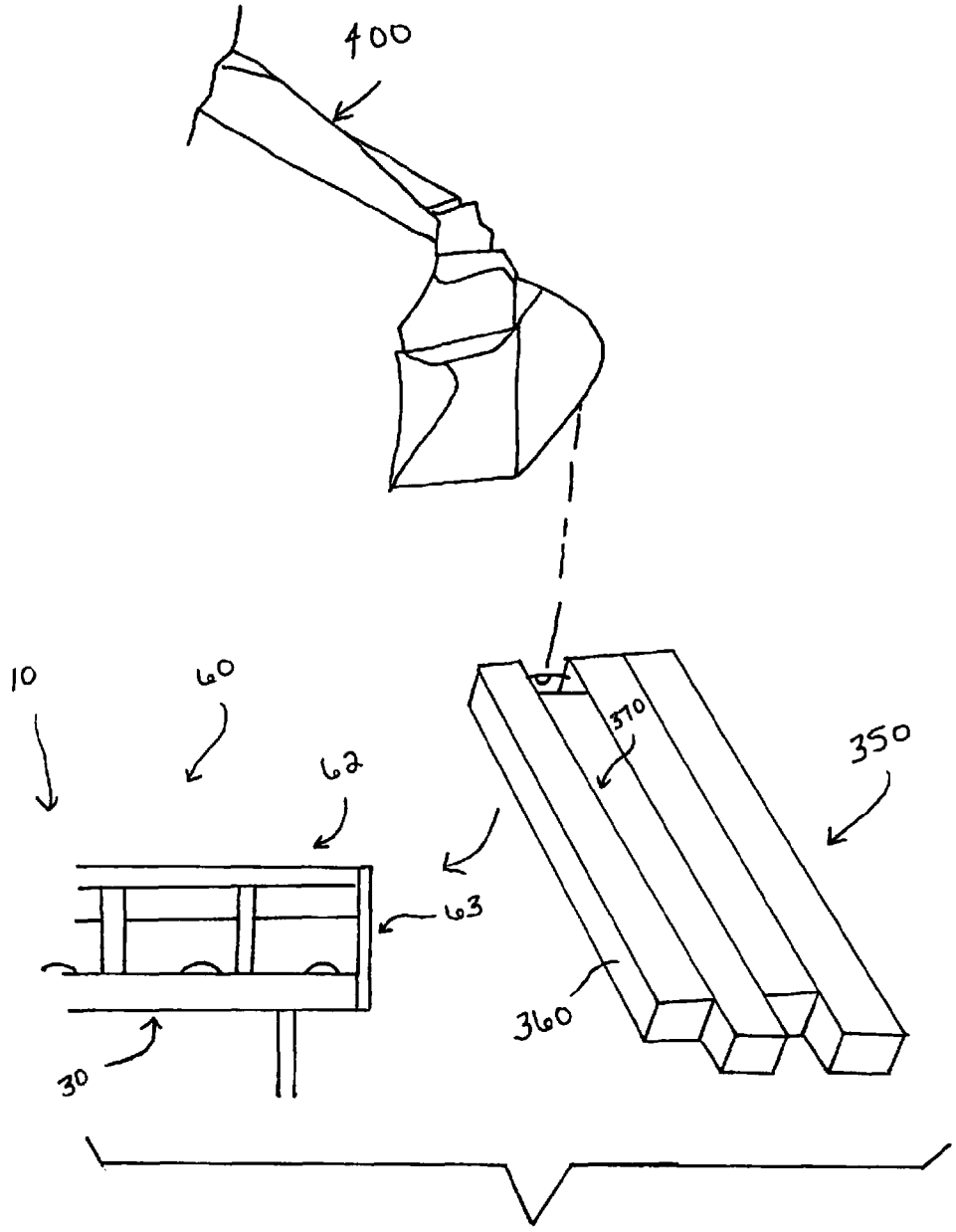
FIG. 27 is a partial perspective view of a method aspect of the present invention.

FIG. 27 further depicts a method aspect of the invention. Heavy equipment, for example equipment 400, is used to pick up swamp mat 350 as is commonly accomplished. Mat 350 is placed on its edge 360 on conveying system 30.

The methods of use described heretofore are only examples of methods of use. It is clear that one skilled in the art may develop other methods of use as suggested by the description that are in the spirit of the invention and are not intended to be excluded from the scope of the invention by not being specifically recited.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise specifically indicated. While the particular MAT WASHING MACHINE AND METHOD OF USING as herein shown and described in detail is fully capable of attaining the above-described aspects of the invention, it is to be understood that it is the presently preferred embodiment of the present invention and thus, is representative of the subject matter which is broadly contemplated by the present invention, that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. section 112, sixth paragraph, unless the element is expressly recited using the phrase "means for."

What is claimed is:

1. A method of washing a swamp mat made of wooden segments, the swamp mat having a side surface and an edge surface, the side surface having a surface area substantially greater than a surface area of the edge surface, said method comprising:

orienting a swamp mat on an exposed powered conveyor by placing the swamp mat on its edge surface; and conveying the swamp mat to an exposed first brush system such that at least a portion of a brush is visible when viewed along a conveying line of said conveyor, and where the mat, upon conveyance from said exposed first brush system, is conveyed along an exposed powered conveyor; and washing the mat.

2. The method of claim 1 further comprising where said placing the swamp mat comprises placing the swamp mat utilizing a piece of heavy equipment.

3. The method of claim 1 where said exposed first brush system is a spinning brush system comprising a pair of spinning drums.

4. The method of claim 3 where the powered conveyor includes at least two independently suspended rollers.

5. The method of claim 4 further comprising an exposed second brush system comprising a fiber brush, said first brush system comprising a cable brush.

6. The method of claim 5 where said placing the swamp mat includes engaging the swamp mat with an exposed beveled channel.

7. A method of washing a swamp mat made of wooden segments, the swamp mat having a side surface and an edge surface, the side surface having a surface area substantially greater than a surface area of the edge surface, said method comprising:

orienting a swamp mat on a conveyor by placing the swamp mat on its edge surface;

conveying the swamp mat to an exposed spinning first brush system such that at least a portion of a brush is visible when viewed along a conveying line of said conveyor, and where said placing the swamp mat includes placing the swamp mat utilizing a piece of heavy equipment; and washing the mat.

8. The method of claim 7 where the mat includes a hook or extending rod and said utilizing a piece of heavy equipment includes grasping the hook or extending rod in order to lift the mat.

9. The method of claim 7 where said placing the swamp mat includes placing the swamp mat on an exposed powered conveyor.

10. The method of claim 9 where the powered conveyor includes at least two independently suspended rollers.

11. The method of claim 7 where the mat, upon conveyance from said exposed first brush system, is conveyed along an exposed powered conveyor to a second brush system.

12. The method of claim 11 where the second brush system is an exposed spinning brush system and includes a fiber brush on a drum.

13. A method of washing a swamp mat made of wooden segments, the swamp mat having a side surface and an edge surface, the side surface having a surface area substantially greater than a surface area of the edge surface, said method comprising:

orienting a swamp mat on a conveyor by placing the swamp mat on its edge surface;

conveying the swamp mat to a first spinning brush system where said placing the swamp mat includes placing the swamp mat utilizing a piece of heavy equipment, where the mat includes a hook or extending rod and said utilizing a piece of heavy equipment includes grasping the hook or extending rod in order to lift the mat.

14. A method of washing a swamp mat made of wooden segments, the swamp mat having a side surface and an edge surface, the side surface having a surface area substantially greater than a surface area of the edge surface, said method comprising:

orienting a swamp mat on a conveyor by placing the swamp mat on its edge surface;

conveying the swamp mat to a first spinning brush system, and where said placing the swamp mat includes placing the swamp mat utilizing a piece of heavy equipment, where said first spinning brush system is an exposed brush system such that at least a portion of a brush is visible when viewed along a conveying line of said conveyor and where the mat, upon conveyance from said exposed first spinning brush system, is conveyed along an exposed powered conveyor; and washing the mat.

15. The method of claim 14 where the mat is further conveyed to a second brush system comprising a pair of spinning drums.

16. A method of washing a swamp mat made of wooden segments, the swamp mat having a side surface and an edge surface, the side surface having a surface area substantially greater than a surface area of the edge surface, said method comprising:

orienting a swamp mat on a conveyor by placing the swamp mat on its edge surface;

conveying the swamp mat to a first spinning brush system, and where said placing the swamp mat includes placing the swamp mat utilizing a piece of heavy equipment, where said placing includes engaging the mat with an exposed rail system.

17. A method of washing a swamp mat made of wooden segments, the swamp mat having a side surface and an edge surface, the side surface having a surface area substantially greater than a surface area of the edge surface, said method comprising:

orienting a swamp mat on a conveyor by placing the swamp mat on its edge surface;

conveying the swamp mat to a first spinning brush system, and where said placing the swamp mat includes placing the swamp mat utilizing a piece of heavy equipment, where said placing includes engaging the mat with an exposed beveled channel.

18. The method of claim 17 where an upper portion of said channel has an opening that is greater than an opening of a lower portion of said channel.

19. The method of claim 14 where said exposed brush system includes a splash guard to partially conceal said brush.

20. A method of washing a swamp mat made of wooden segments, the swamp mat having a side surface and an edge surface, the side surface having a surface area substantially greater than a surface area of the edge surface, said method comprising:

orienting a swamp mat on a conveyor by placing the swamp mat on its edge surface and within a beveled channel;

thereafter conveying the swamp mat to a first spinning brush system, and where said placing the swamp mat includes placing the swamp mat utilizing a piece of heavy equipment.

21. The method of claim 20 where said beveled channel is defined at least in part by a rail.

22. The method of claim 13 where said piece of heavy equipment is one selected from the group consisting of a crane, a swing-boom crane, a backhoe, and an end-loader.

* * * * *